United States Patent [19]

Collins

[11] 4,055,101

[45] Oct. 25, 1977

[54] ROLL FED ROTARY WEB DEVICE WITH IMPROVED PERFORATOR

[75] Inventor: Joseph Martin Collins, Ontario, N.Y.

[73] Assignee: Burroughs Corporation, Detroit, Mich.

[21] Appl. No.: 687,806

[22] Filed: May 19, 1976

[51] Int. Cl.[2] ..... B26F 1/20

[52] U.S. Cl. ..... 83/660; 29/465; 144/130; 33/185 R

[58] Field of Search ..... 83/660; 144/130; 33/185 R; 29/465; 144/230, 218, 229

[56] References Cited

U.S. PATENT DOCUMENTS

| | | | |
|---|---|---|---|
| 2,496,800 | 2/1950 | Larkins | 144/130 X |
| 2,801,439 | 8/1957 | Meares | 83/660 |
| 2,814,320 | 11/1957 | Dukes et al. | 144/230 |
| 3,894,340 | 7/1975 | Ellis | 33/185 R |

*Primary Examiner*—Donald R. Schran

*Attorney, Agent, or Firm*—Kevin R. Peterson; Lynn L. Augspurger

[57] ABSTRACT

Disclosed is a roll fed rotary web device such as a rotary offset or rotogravure web printing press or a collator, having an improved perforator. Also disclosed are examples of prior art perforators. The perforator is incorporated in a standard perforating cylinder which rotates during the process of perforation. Perforating blades are mounted in the perforating cylinder and several improvements relating to spring biased positioners of the perforating blade are illustrated.

4 Claims, 4 Drawing Figures

ROLL FED ROTARY WEB DEVICE WITH IMPROVED PERFORATOR

BACKGROUND OF THE INVENTION

1. Field of the Invention

This invention relates to printing presses or collators that have a rotary web type. Particularly the printing press or collator is incorporated with an improved perforating cylinder and with means to improve setting of the perforating blades by the machine operator.

2. The Prior Art

There are essentially three existing methods, which are illustrated in the drawings generally used by machine operators at the present time.

These prior art devices include a set by eye type, a set to rule type and a set to gauge type method used to set perforation or cut off blades on the perforating cylinders of roll fed rotary devices.

Each of these existing practices has disadvantages either in cumbersomeness or accuracy.

SUMMARY OF THE INVENTION

The invention disclosed herein relates to an improved blade seating aid which provides a surface to which a cut off or perforating blade is mounted at the prestrike in height in the perforating cylinder. The surface is deformable to allow strike-in to be achieved. The aid is an integral part of the back-up bar design, eliminating the need for gauges, and "eyeballing" practices used heretofore. The set-up is expedited and considerable savings of time is achieved without the need of learned "operator technique".

BRIEF DESCRIPTION OF THE DRAWINGS

The above and other objects, advantages and features of the present invention will become more readily apparent from a review of the following description when taken in relation to the drawings wherein.

GENERAL DESCRIPTION OF THE INVENTION

Figure 1:
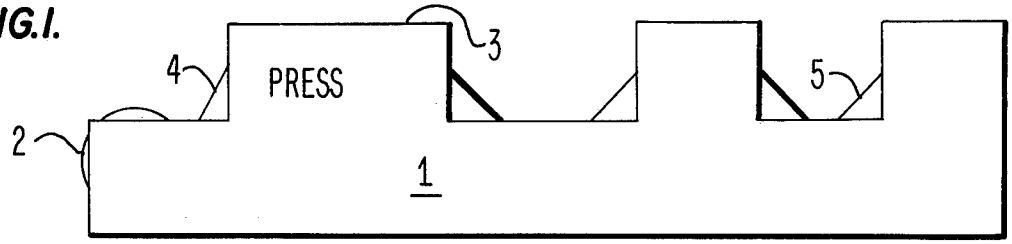
FIG. 1 is a side elevation of a press incorporating the present invention.
Figure 2:
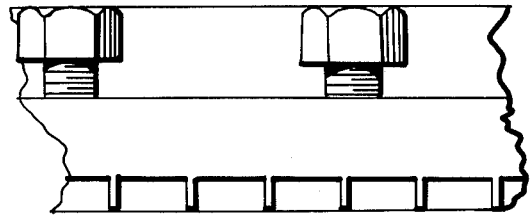
FIG. 2 is a partial top plan view of the perforator cylinder taken to show the groove in which the perforation blade is mounted.
Figure 3:
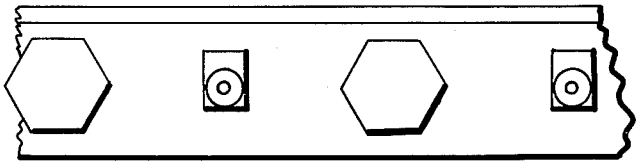
FIG. 3 is a view taken in section of the groove in which a perforation blade is mounted in a perforation cylinder.

In FIG. 1 it will be seen that a rotary web press of the rotary offset or rotogravure type incorporating the present invention has a start roll of paper mounted on the press 1. The paper 4 is drawn from a roll 2 to a print station 3 and thereafter to other stations in the press. One of these stations is located at a perforation station 5. In this perforation station is mounted for rotation a perforation cylinder incorporating improvements made thereto. This perforation cylinder is journaled in the frame of the press and is a cylindrical member having a plurality, usually three to six of grooves or channels machined in the cylinder and aligned with the axis of the cylinder.

Figure 4:
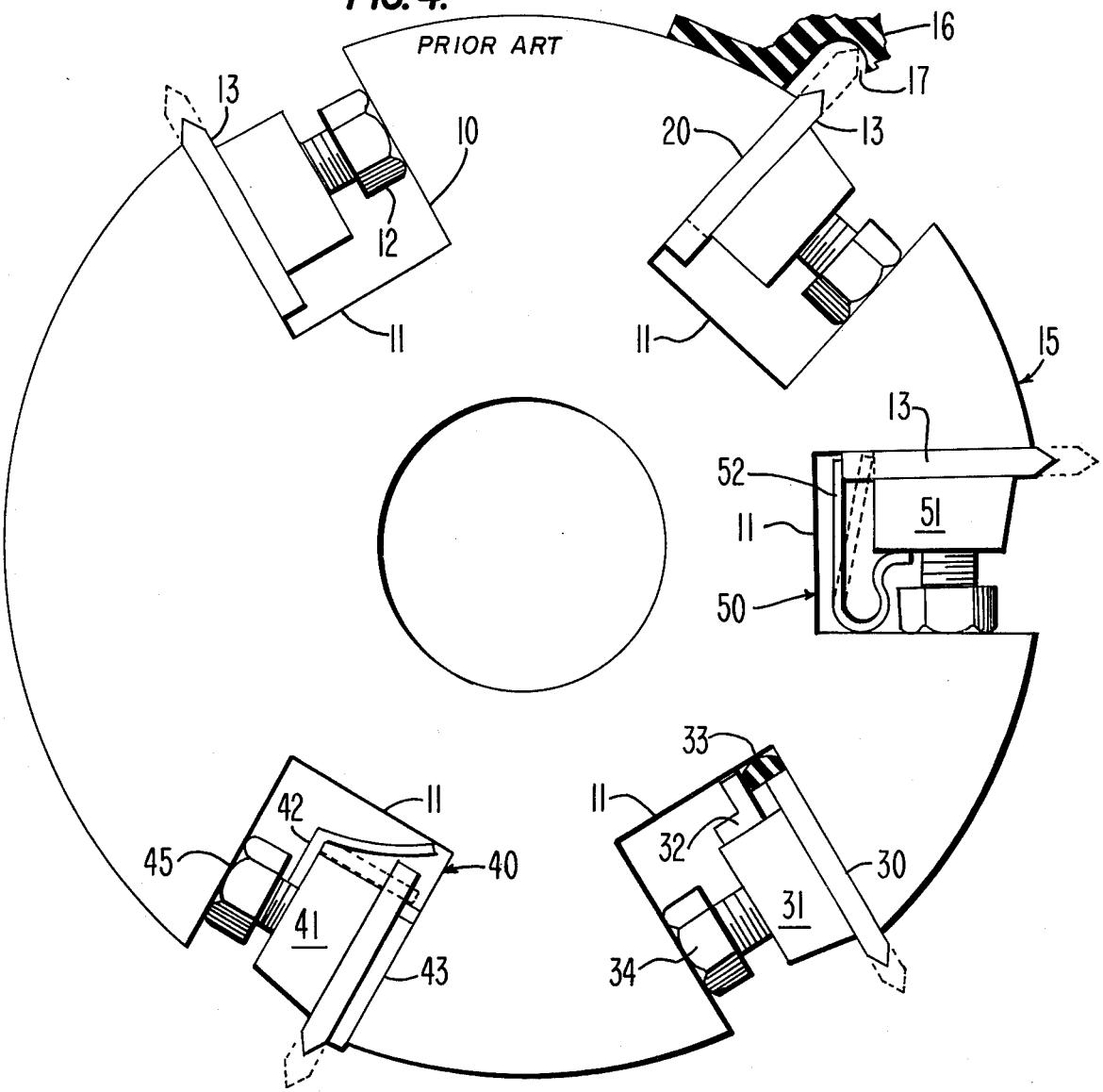
FIG. 4 is a sectioned end view of the perforation cylinder on which is mounted, not only the prior art, but the elements of the preferred embodiment of the invention and alternative embodiments of the present invention.

A section of the cylinder is shown in FIG. 4. At station 10 in FIG. 4, the groove 11 as mounted therein the cut off or perforation blade in which the pre-strike-in height of the perforation blade is indicated by the dotted line. This blade can be set in position by several methods. In the "set by eye" method, the predominate method presently used in production, a collator or press operator holds his blade in place approximately 0.060 inches above the cylinder surface. He then spot tightens a few of the back-up nuts 12 to hold the blade 13 in place. Next he uses a torque wrench to tighten each of the back-up nuts to the established "strike in" torque. By jogging his press or collator the operator "strikes-in" his blade against the solid anvil or cut off cylinder against which the perforation cylinder rotates during the course of printing production. By this method he establishes the required parallelism for his cutting surfaces. His last step is to tighten each back-up nut in a lock torque position which conserves a set parallelism during the run conditions and sets the blade in the positions shown at position 10 in solid lines. This entire procedure is repeated for each blade commonly two to six blades around the cylinder.

The "set by eye" procedure produces the poorest quality perforations and blade life. As non-parallel "strike in" causes mashing or blunting of the teeth or cutting edge against the solid cut-off cylinder. This also requires a certain technique on the part of the operator because sighting of the parallelism is a learned art. The principle advantage of this procedure is its obvious expediency.

An alternate to the above described past practice would utilize a ruler, such as a six inch steel ruler, to set the blade to pre-strike-in (approximately 0.060 inches) height. By pressing the blade in 13 into the slot 11 until the ruler (not shown) strikes the perforation cylinder surface the operator can set the blade parallel to that surface at a height equal to the depth of the perforation slot. The strike-in and torqueing procedure is the same as described in the "set by eye" method. This method produces consistently better quality but is not very reliable as the procedure requires that the operator be reliable, not only as to this technique but also as to his use of the ruler technique. Quite commonly the ruler is discarded as the operator gains self assurance. Additionally the set to ruler method can only be used on particular perforation blades where the perforation slot depth corresponds to the pre-strike-in height. It can not be used on a solid cut-off blade.

Another method might be called the "set-to-gauge" method. In this method the perforation or cut off cylinder 15 is used as a support service for a gauge 16, whether metal or plastic. The gauge is aligned in an axial direction along the perforation or cut off blade. The gauge acts as a height gauge for the pre-strike-in height and the blade is drawn into the gauge notch 17. The strike in and torqueing procedures are similar to the aforedescribed methods and the blade 13 at the strike-in position operates in the same manner. This "set-to-gauge" method provides the most consistent set up for all types of blades. It maximizes blade life and provides consistent quality from operator to operator. However, this method does require 20 to 25 percent more time per blade for set up because of the cumbersome gauge hardware. Operators as they become more self-assured have tended to discard the gauge and adopt the expedient "eye ball" method first described. The gauge position 20 can be considered to be illustrative of the prior art.

The remaining three stations 30, 40 and 50 illustrate three embodiments of the present invention. At station 30 the backing plate or lug has affixed thereto, such as by welding, a backing bracket 32 which positions an elastomeric bumper, such as a rubber mounting block 33 in the groove beneath the blade position. The bumper in the undeformed position sets the blade to the pre-strike-in height. The blade is dropped into place. The press or collator operator proceeds to tighten all nuts to the strike in torque without concern for fixing the blade to a gauge or "eye ball" dimension. Strike-in against the anvil or cut-off cylinder is accomplished in accordance with the aforedescribed procedure and the nuts 34 are tightened to lock torque. This elastomeric bumper is an alternate embodiment of the preferred inventions illustrated in stations 50 and 51.

One of the preferred configurations of the invention is the utilization of an L shaped leaf spring affixed in position, such as by spot welding, to the lug 41. The L shaped leaf spring 42 in its undeformed position acts as a shelf or surface for the blade 13 as it is inserted into the groove 11. In order to be assured that the leaf spring when deformed by clamping with no blade in the groove does not bottom out, I have provided a back-up insert plate 43. Again the leaf spring surface acts as a pre-strike-in ledge prebiasing the inserted perforation or cut-off blade to the pre-strike-in position.

The undeformed spring, acting like a ledge, positions the blade while the tightening to pre-strike-in torque is made in the manner heretofore described by tightening the nuts 41 with the bolt 45. Once this blade has been set it is moved against the anvil or cut-off cylinder to move the blade back into strike-in height. This action deforms the leaf spring and all the springs along the blade are deformed to lock torque. Again the need for a gauge or eye balling is eliminated.

Another preferred embodiment of the invention is shown at station 50. In this position the lug backing plate 1 has affixed thereto a variant leaf spring 52 shown in solid line in its deformed or strike-in position. The dotted line shows the undeformed leaf spring 52.

This preferred embodiment of the leaf spring is again affixed, such as by welding, to the lug 51.

The leaf spring of this embodiment has a coiled leaf spring which has a longer section in the undeformed position spaced from the flat mounting portion by an arc of about 75°. The longer portion extends past the normal point of intersection of the flat mounting portion such that an arc of approximately 180° can be formed therein. Such a coiled leaf spring prevents permanent deformation in the spring-in position and eliminates the need for a back-up plate, such as that at 43.

My experiments with the preferred embodiments of the invention (Re: 50,51) have shown that the set-up rate for new blades is improved over that of the eye-ball method and accordingly is much improved over that utilizing gauges and rulers. Operator technique was not found to be significant and a blade set-up procedure yielded perforation quality equal to that of the manufacturing gauge. As both presses and collators are now provided with this improvement, the operator does not need to "lose" his gauge and the parallelism required for a proper cutting surface is readily obtained without mashing or blunting of teeth or cutting edge. There is no inconsistency from operator to operator.

While the preferred embodiments of the invention have been shown in detail and described with reference to the prior art known to me, various modifications and rearrangements may be made in the press and perforation cylinder and the process of setting-up the perforation cylinder as may occur to those skilled in the art both now and in the future. The scope of my invention is to be determined with reference to the following claims.

I claim:

1. A roll fed rotary web device, such as printing press or collator, having:

a roll feed station, and a perforation station, the perforation station having a perforation cylinder in which there is a longitudinal groove across the cylinder aligned with the axis of the cylinder, at least one lug plate and fastening member located within the groove such that a perforation blade can be set between the lug plate and the side wall of the groove and the perforation cylinder, a support surface normally positioned to support an inserted perforation blade to increase strike-in position being provided to support the perforation blade above the bottom surface of said groove and between said lug and side wall of said groove, said support surface element being deformable by pressure applied to the perforation blade.

2. The roll fed rotary web device according to claim 1 wherein the support surface element is a deformable elastomer.

3. The roll fed rotary web device according to claim 1 wherein the support surface is a leaf spring and by which the underformed position of the spring positions the blade in the groove at a point above that which is to be the strike-in position.

4. The roll fed rotary web device according to claim 3 wherein the leaf spring is a coiled leaf spring.

* * * * *